US005704809A

United States Patent [19]

Davis

[11] Patent Number: 5,704,809

[45] Date of Patent: Jan. 6, 1998

[54] COAXIAL ELECTRICAL CONNECTOR

[75] Inventor: Jeffrey Paul Davis, Harrisburg, Pa.

[73] Assignee: The Whitaker Corporation, Wilmington, Del.

[21] Appl. No.: 506,938

[22] Filed: Jul. 26, 1995

[51] Int. Cl.[6] ..... H01R 9/05

[52] U.S. Cl. ..... 439/578; 439/580; 439/349

[58] Field of Search ..... 439/578–585, 439/347, 349, 741, 744–747

[56] References Cited

U.S. PATENT DOCUMENTS

| | | | |
|---|---|---|---|
| 3,275,970 | 9/1966 | Johanson et al. | 439/578 |
| 4,708,666 | 11/1987 | Fisher, Jr. | 439/580 |
| 4,813,887 | 3/1989 | Capp | 439/580 |
| 5,131,868 | 7/1992 | Forterre | 439/582 |
| 5,277,590 | 1/1994 | Thomas et al. | 439/20 |
| 5,288,242 | 2/1994 | Muzslay | 439/349 |

*Primary Examiner*—J. J. Swann

[57] ABSTRACT

An electrical coaxial precision connector is disclosed that is manufactured from die castings and deep drawn parts. A first connector (80) includes a receptacle contact 86, a conductive body (88) attached at one end to the receptacle contact, a central pin contact (90), and a dielectric member disposed between the pin and the conductive body (88). A second connector (82), which mates with the first connector (80), includes a conductive body (160) having a pin contact (166) formed integral thereto, an inner receptacle contact (162), and a dielectric member (164) disposed between the receptacle contact and the conductive body (160). Each of the connectors includes a retaining ring that loosely encircles a recessed diameter (100, 170) in the connector and secures the connector in an opening (148, 202) in a housing (84). The retaining ring (130) includes camming surfaces (144, 146) on its ends (140, 142) and is made of a relatively soft plastic so that it does not mar the plated surfaces (100, 170) of the connector when assembled thereto.

5 Claims, 5 Drawing Sheets

COAXIAL ELECTRICAL CONNECTOR

The present invention relates to precision coaxial electrical connectors that are held in a housing by a retaining ring and more particularly to such connectors of improved structure and having an improved retaining ring.

BACKGROUND OF THE INVENTION

Certain coaxial precision electrical connectors for use in the telecommunications and other industries utilize parts that are manufactured by screw machine, plated, and then assembled into the final connector. These connectors are held to close tolerances to conform to military specifications as required for certain military applications and, therefore, are expensive to manufacture. Such connectors are manufactured by AMP Incorporated of Harrisburg Pa., a mating pair of which are distributed as Part Nos. 228596-x and 228618-x, and are shown in FIGS. 1 and 2, respectively. This connector pair includes a receptacle connector 10, as shown in FIG. 1, and a mating pin connector 12, as shown in FIG. 2. The receptacle connector 10 includes a conductive body 14 having a reduced diameter 16 adjacent an end thereof, and an outer receptacle contact member 18 that is crimped onto the end of the conductive body as shown at 20 in FIG. 1. The outer surfaces of the conductive body are plated with a relatively soft, electrically conductive material such as gold. An inner pin contact 22 is disposed within the conductive body 14 coaxial to the body 14 and the outer receptacle contact 16. A dielectric member 24 is held in an inner bore in the conductive body 14 by being staked about the reduced diameter 16. The inner pin contact 22 is secured in a central opening in the dielectric member 24 by means of an annular barb 26 in the usual manner. A hub 20 extends from the end of the conductive body opposite the outer receptacle contact 16, as shown, for receiving and terminating the shield of a coaxial cable in the usual manner. The end of the conductive body 14 is rolled over or crimped onto the hub 28 as shown at 30 in FIG. 1. A C-shaped retaining ring 32 is arranged in loosely surrounding engagement with the reduced diameter 16 between a shoulder 34 and the end of the outer receptacle contact 16. The retaining ring 32, as best seen in FIGS. 3 and 4, includes a tapered outer surface 36 and two ends 38 and 40. The inner diameter 42 of the retaining ring 32 is greater than the reduced diameter 16 of the conductive body but the two ends 38 and 40 are spaced apart a distance that is less that the reduced diameter 16, so that the ring 32 is captive to the conductive body 14. The retaining ring 32 is arranged to secure the connector 10 in an opening in a housing, not shown. As the connector 10 is inserted into the opening in the housing, the tapered surface 36 engages the edge of the opening and cams inwardly to reduce the outer diameter of the ring 32 until it passes into and through the opening, and then snaps outwardly to its original position to lock against a shoulder in the housing. The retaining ring 32 is made of a beryllium copper because of its resilient properties and is assembled to the conductive body 14 by expanding the ring outwardly by forcing the two ends 38 and 40 apart a greater distance than the diameter of the reduced diameter. The ring 32 is then moved laterally into surrounding engagement with the reduced diameter 16 and then crimped slightly to return it to its original shape and position shown in FIG. 1. This final crimping operation, while being in added complexity and expense in the manufacturing process, is required because the expansion of the ring 32 causes the ring 32 to deflect past its elastic limit. Further, if the retaining ring 32 is not expanded sufficiently the ends 38 and 40 will drag over the surface of the reduced diameter 16, marring it, cutting through the relatively soft plating, or otherwise damaging it, all of which are unacceptable. Therefore, the only current option is to expand the ring 32 beyond its elastic limit and then reform it to its original shape after assembly to the conductive body 14.

Similarly, the pin connector 12, as shown in FIG. 2, includes a conductive body 54 having a reduced diameter 56 adjacent an end thereof, and an outer pin contact member 58 that is integral with the conductive body 54 as shown in FIG. 2. The outer surfaces of the conductive body 54 are plated with a relatively soft, electrically conductive material such as gold. An inner receptacle contact 62 is disposed within the conductive body 54 coaxial to the body 54 and the outer pin contact 58. A dielectric member 64 is held in an inner bore in the conductive body 54 by being staked about the reduced diameter 56. The inner receptacle contact 62 is secured in a central opening in the dielectric member 64 by means of an annular barb 66 in the usual manner. The outer pin contact 58 and the inner receptacle contact 62 are arranged to mate with the outer receptacle contact 18 and inner pin contact 22, respectively, of the receptacle connector 10. A hub 68 extends from the end of the conductive body 54 opposite the outer pin contact 56, as shown, for receiving and terminating the shield of a coaxial cable in the usual manner. The end of the conductive body 54 is rolled over or crimped onto the hub 68 as shown at 70 in FIG. 1. A C-shaped retaining ring 72 similar to the retaining ring 32 is arranged in loosely surrounding engagement with the reduced diameter 56 between two shoulders 74 and 76. The retaining ring 72 is assembled to the conductive body 54 in the same manner as the retaining ring 16 and conductive body 14 are assembled. Additionally, the conductive bodies 14 and 54 and hubs 28 and 68 are deep drawn parts which adds to the expense of manufacturing the connector.

What is needed is a precision coaxial connector that is relatively inexpensive to make and that includes a retaining ring that can be assembled to the conductive body without expanding and reforming and without marring or otherwise damaging the soft plated surface of the conductive body.

SUMMARY OF THE INVENTION

A coaxial electrical connector is provided having a conductive body of unitary construction and an outer receptacle contact for interconnection with an outer pin contact of a mating connector. The receptacle contact has a contact portion and a shank attached to the conductive body. The shank has an outer diameter and an inner diameter, at one end of which, the shank joins the contact portion through a raised shoulder. The coaxial connector includes an inner pin contact for interconnection with an inner receptacle contact of a mating connector. The pin contact is arranged coaxially within the outer receptacle contact. A dielectric member is provided in engagement with the inner pin contact and the inner diameter of the shank. A retaining ring surrounds a portion of the outer diameter of the shank between the shoulder and an end of the conductive body for holding the connector captive within an opening in a housing.

DESCRIPTION OF THE PREFERRED EMBODIMENT

Figure 1:
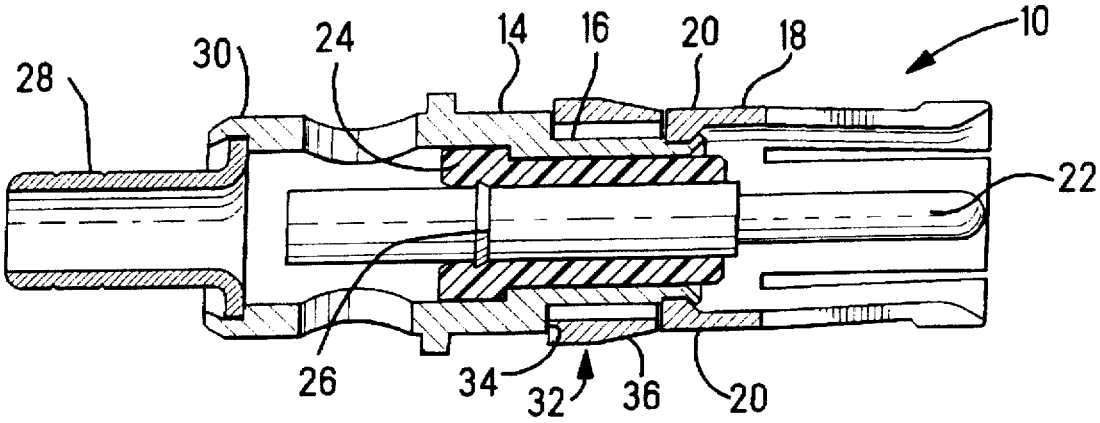
Fig. 1 PRIOR ART
FIG. 1 is a cross-sectional view of a prior art coaxial receptacle connector.
Figure 2:
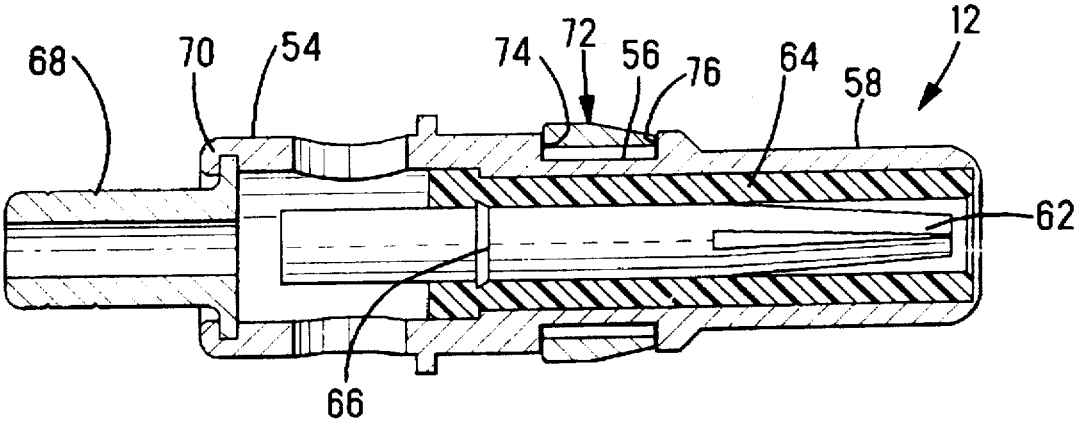
Fig. 2 PRIOR ART
FIG. 2 is a cross-sectional view of a prior art coaxial pin connector that mates with the connector of FIG. 1.
Figure 3:
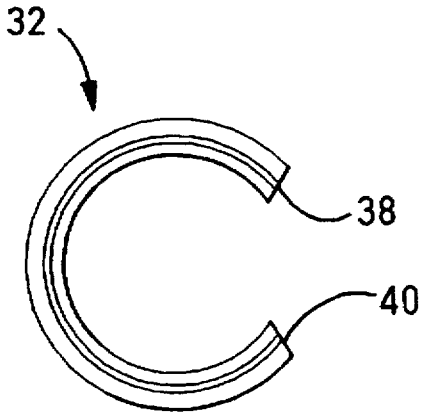
PRIOR ART Fig. 3
FIG. 3 is a front view of the retaining ring shown in FIG. 1.
Figure 4:
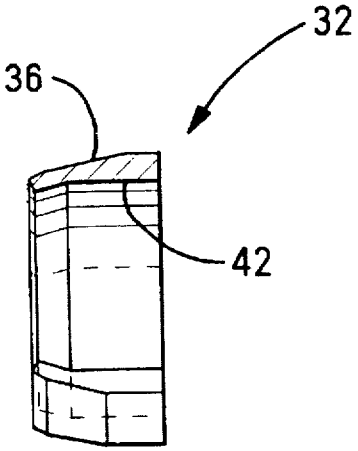
PRIOR ART Fig. 4
FIG. 4 is a side view of the retaining ring shown in FIG. 1.
Figures 5, 6, 7:
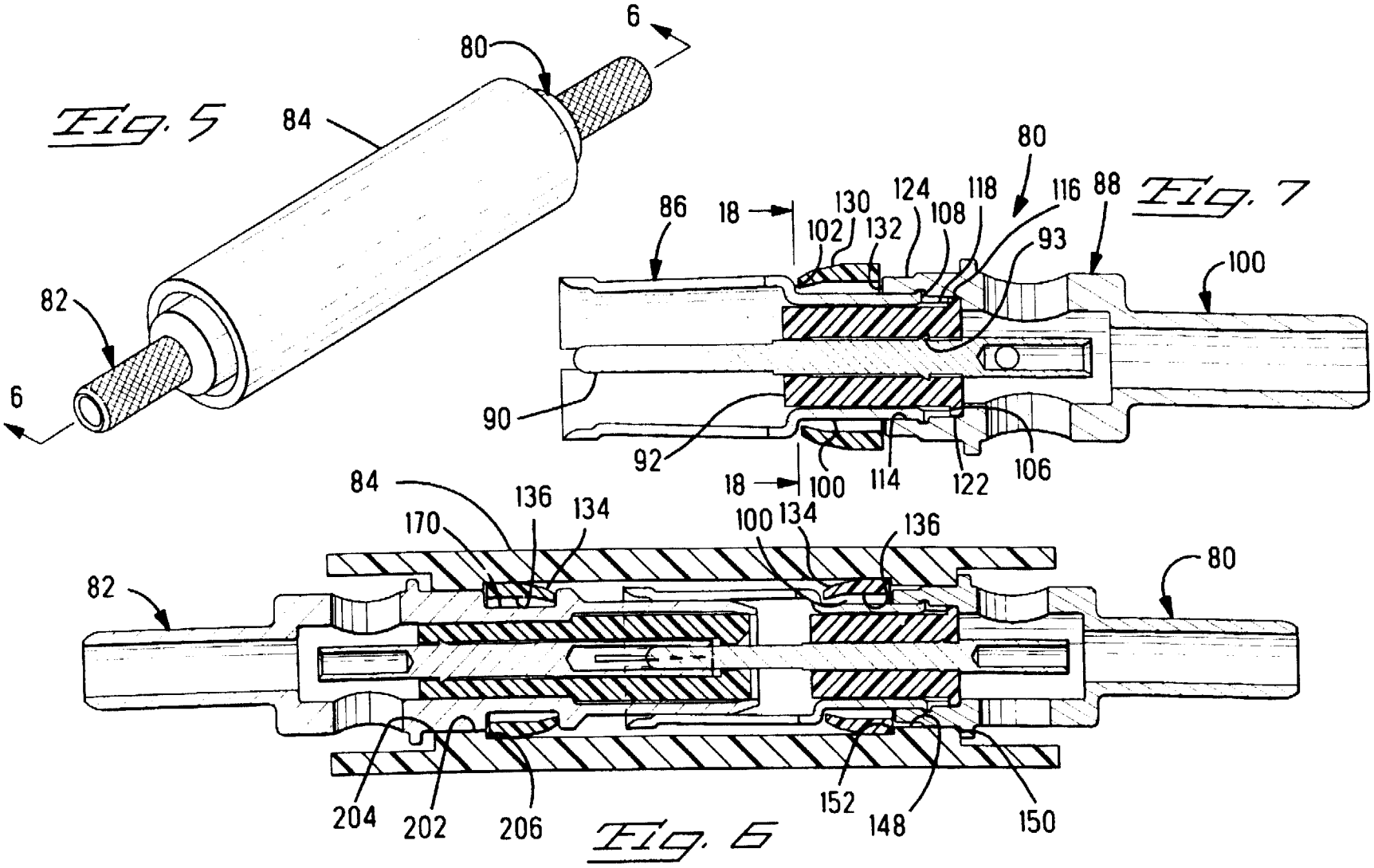
FIG. 5 is an isometric view of a receptacle connector and mating pin connector assembled to a housing, incorporating the teachings of the present invention.
FIG. 6 is a cross-sectional view taken along the lines 6—6 in FIG. 5.
FIG. 7 is a cross-sectional view of the receptacle connector shown in FIG. 6.
Figure 10:
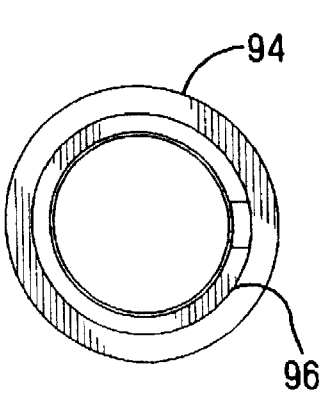
FIG. 10 is a right end view of the receptacle contact shown in FIG. 8.
Figure 12:
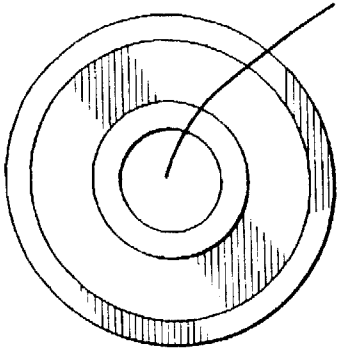
FIG. 12 is an end view of the conductive housing shown in FIG. 7.
Figure 8:
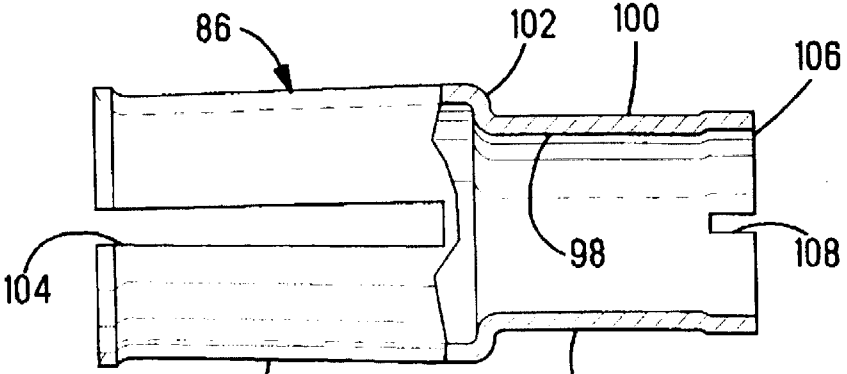
FIG. 8 is a side view of the receptacle contact shown in FIG. 6.
Figure 11:
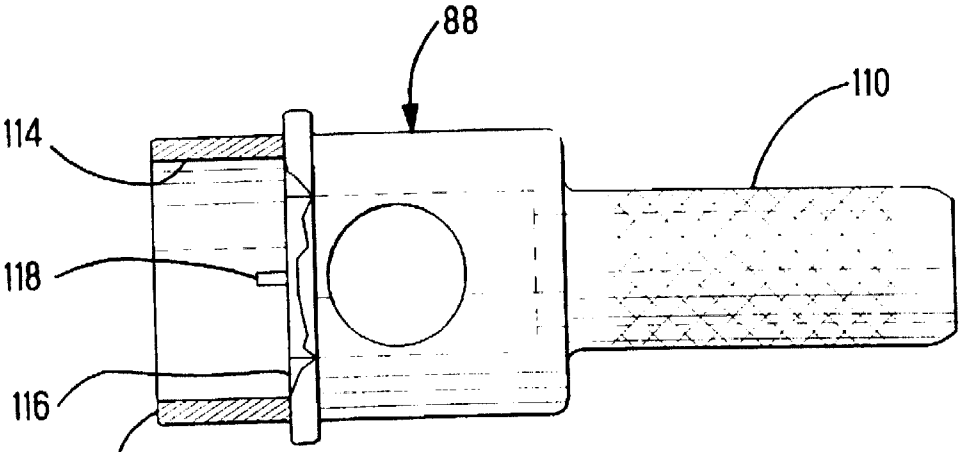
FIG. 11 is a front view of the conductive housing shown in FIG. 7.
Figure 9:
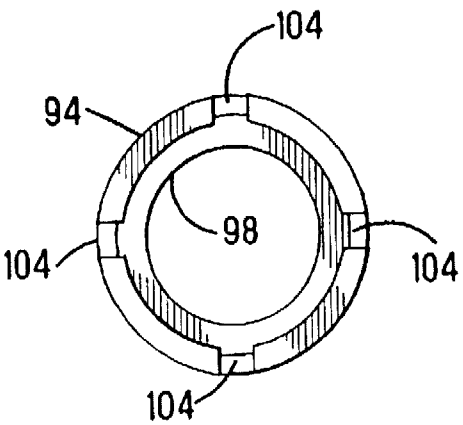
FIG. 9 is a left end view of the receptacle contact shown in FIG. 8.

There is shown in FIGS. 5 and 6 an isometric view of a receptacle connector 80 and mating pin connector 82 assembled to a housing 84. The receptacle connector 80, as best seen in FIG. 7, includes an outer receptacle contact 86, an electrically conducting body 88 having an end that is securely attached to one end of the receptacle contact 86, an inner pin contact 90, and a dielectric member 92 that is disposed between the inner pin contact 90 and the conducting body 88. The pin contact 90 is secured to the dielectric member 92 by means of an annular barb 93 in the usual manner. The outer receptacle contact 86, as best seen in FIGS. 8, 9, and 10, is a deep drawn part of unitary construction and has a contact portion 94 and a shank portion 96. The shank 96 includes an inner diameter 98 and a reduced outer diameter 100 that joins the contact portion 94 in a raised shoulder 102. The contact portion 94 is segmented by four slots 104 in the usual manner. The shank 96 terminates in an end 106 having a slot 108 formed therein that intersects the outer diameter 100 for a purpose that will be explained. The entire receptacle contact 86 is plated with an electrically conductive low resistance and non corrosive material, such as gold, in the usual manner. As will be explained below, such plated materials are relatively soft and malleable and, therefore, are easily damaged when assembling the various parts of the connector. The conductive body 88 is die cast of a suitable electrically conductive material and is of unitary construction. As best seen in FIGS. 11 and 12, the conductive body 88 includes a knurled hub 110 formed integral thereto and extending from one end for terminating the shield conductor of a coaxial cable in the usual manner. A hole 112 extends axially through the conductive body 88 and a counterbore 114 extends from the opposite end into the body 88 terminating in a shoulder 116. The diameter of the counterbore 114 is sized to be a loose slip fit with the outer diameter 100 of the shank 96. A key 118 projects from the wall of the counterbore 114 adjacent the shoulder 116 and is sized to be received in the slot 108 and serves to prevent rotation of the outer receptacle contact 86 with respect to the conductive body 88 after assembly. The conductive body 88 with integral hub 102 is less expensive to manufacture than is the two part body and hub of the prior art connector 10.

Figure 14:
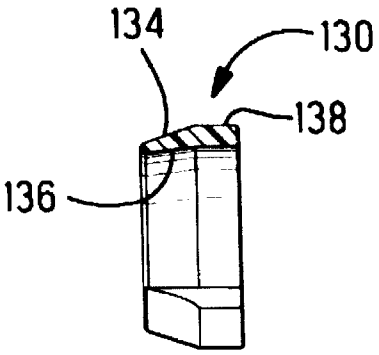
FIG. 14 is a side view of the retaining ring shown in FIG. 7.
Figure 13:
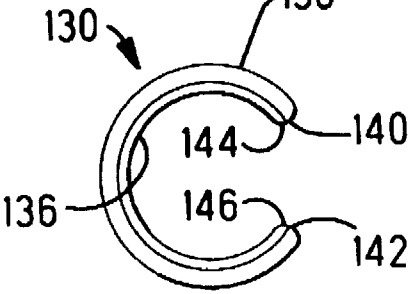
FIG. 13 is an end view of the retaining ring shown in FIG. 7.
Figure 20:
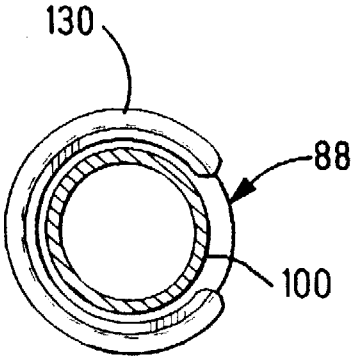
FIG. 20 is a cross-sectional view taken along the lines 18—18 in FIG. 7 showing the retaining ring in a third stage of assembly.
Figure 19:
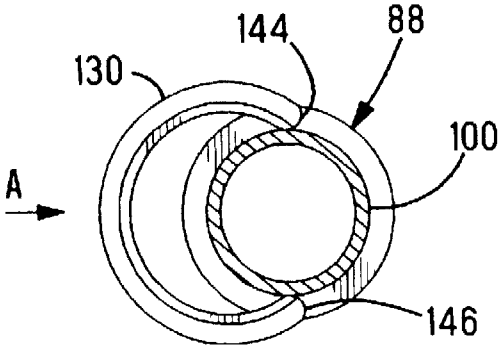
FIG. 19 is a cross-sectional view taken along the lines 18—18 in FIG. 7 showing the retaining ring in a second stage of assembly.
Figure 18:
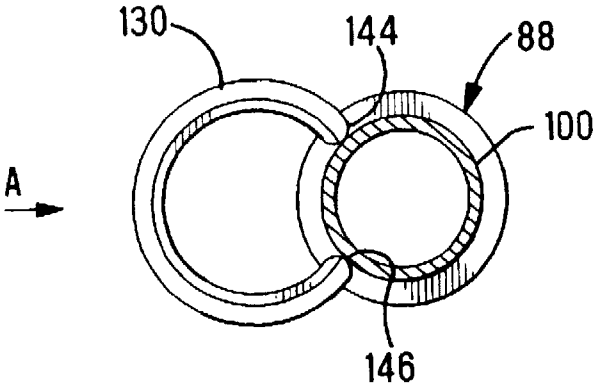
FIG. 18 is a cross-sectional view taken along the lines 18—18 in FIG. 7 showing the retaining ring in a first stage of assembly.

As best seen in FIG. 7, the pin contact 90, receptacle contact 86 and conductive body 88 of the connector 80 are in mutual coaxial alignment. The dielectric member 92 includes a flange 122 at one end thereof that is disposed between the end 106 of the receptacle contact 86 and the shoulder 116 of the conductive body 88. This prevents axial movement of the dielectric member 92. The key 118 projecting from the counter bore 114 extends into the slot 108 in the shank 96 to prevent relative rotation of the two parts. The conductive body 88 is crimped onto the reduced outer diameter 100 in the area 124 to secure the two parts together in the position shown in FIG. 7. A C-shaped retaining ring 130 is arranged in loosely surrounding engagement with the reduced outer diameter 100 between the shoulder 102 of the receptacle contact 86 and an end 132 of the conductive body 88. The retaining ring 130, as best seen in FIGS. 13 and 14, includes a tapered outer surface 134, an inner wall or diameter 136, and an outer wall or diameter 138. The inner and outer walls 136 and 138 terminate in two ends 140 and 142 which have radiused camming surfaces 144 and 146, respectively for a purpose that will be explained. The inner diameter 136 of the retaining ring 130 is greater than the reduced outer diameter 100 of the receptacle contact 86 but the two ends 140 and 142 are spaced apart a distance that is less than the reduced outer diameter 100, so that the ring 130 is held captive to the receptacle contact 86. The retaining ring 130 is made of a suitable thermoplastic resin. The ring 130 includes properties that allow it to resiliently deflect outwardly when it is assembled to the receptacle contact 88. The ring 130 is expanded outwardly by forcing the two end 140 and 142, in the direction of the arrow A, against the outer reduced diameter 100, as shown in FIG. 18. As movement continues in the direction of the arrow A, the radiused camming surfaces 144,146 cam outwardly as they ride around the diameter 100, forcing the ends 140 and 142 apart until the two ends pass over the high point of the diameter, as shown in FIG. 19, and then return to their tree state position with the ring 130 in surrounding engagement with the outer reduced diameter 100, as shown in FIGS. 7 and 20. At this point the retaining ring 130 is held captive on the connector 80. The retaining ring 130 is arranged to secure the connector 80 in an opening 148 in the housing 84, as shown in FIG. 6. As the connector 80 is inserted into the opening 148, the tapered surface 134 engages an edge 150 of the opening and cams inwardly to reduce the outer diameter of the ring 130 until it passes into and through the opening 148, and then snaps outwardly to its original position to lock against a shoulder 152 in the housing. There is sufficient clearance between the inner diameter 136 of the ring 130 and the diameter 100 of the receptacle contact 86 for the ring 130 to reduce in size and pass through the opening 148.

Figure 15:
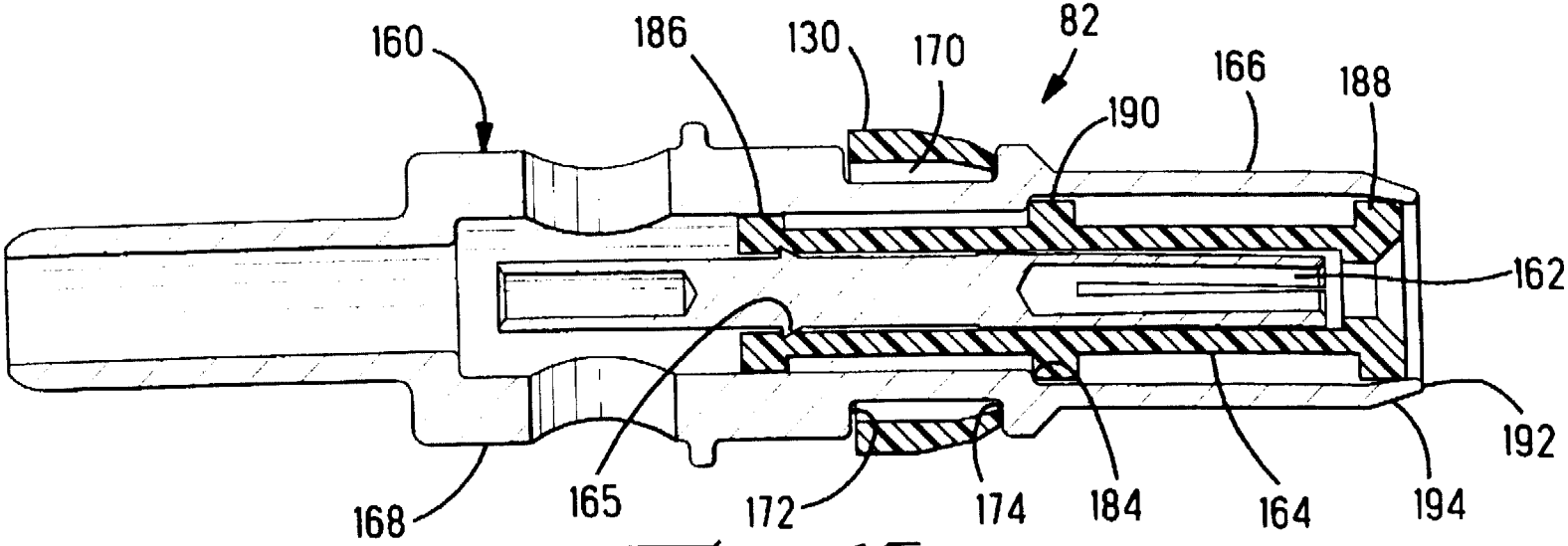
FIG. 15 is a cross sectional view of the pin connector shown in FIG. 6.
Figure 17:
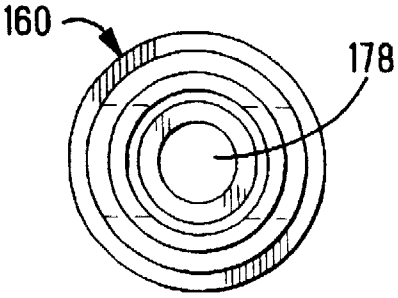
FIG. 17 is an end view of the conductive housing shown in FIG. 15.
Figure 16:
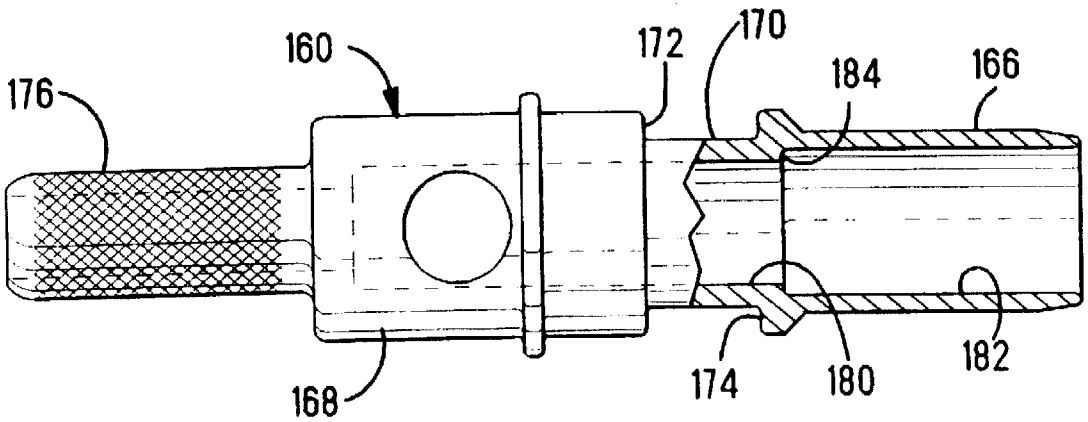
FIG. 16 is a front view of the conductive housing shown in FIG. 15.

Similarly, the pin connector 82, as shown in FIG. 15, includes an electrically conducting body 160 having an inner receptacle contact 162 and a dielectric member 164 that is disposed between the inner receptacle contact 162 and the conducting body 160. The receptacle contact 162 is secured to the dielectric member 164 by means of an annular barb 165 in the usual manner. The conductive body 160, as best seen in FIGS. 15 17, is a die casting of unitary construction and has a pin contact portion 166, arrange for mating engagement with the receptacle contact 86, and a shank portion 168. A reduced diameter 170 having two side walls or shoulders 172 and 174 is formed in the shank 168. As with the receptacle conductive body 88, the outer surfaces of the pin conductive body 160 are plated with an electrically conductive low resistance and non-corrosive material, such as gold, in the usual manner. As stated above, such plated materials are relatively soft and malleable and, therefore, are easily damaged when assembling the various parts of the connector. As best seen in FIGS. 16 and 17, the conductive body 160 includes a knurled hub 176 formed integral thereto and extending from one end of the shank 168 for terminating the shield conductor of a coaxial cable in the usual manner. A hole 170 extends axially through the conductive body. A first counterbore 180 extends from the end opposite the hub 176 into the body 160 and a second counterbore 182 of larger diameter extends into the same end of the body 160 a shorter distance than the first counterbore and terminates in a shoulder 184. The conductive body 160 with integral hub 176 is less expensive to manufacture than is the two part body and hub of the prior art connector 12. As best seen in FIG. 15, the receptacle contact 162, dielectric member 164, and conductive body 160 of the connector 82 are in mutual coaxial alignment. The dielectric member 164 includes two end flanges 186 and 188 that are slip fits with the first and second counterbores 180 and 182, respectively. The dielectric member 164 includes a central flange 190 disposed between the two end flanges 186,188 that is in engagement with the shoulder 104. An end 192 of the pin contact portion 166 is rolled over or crimped, as shown at 194, against the flange 188 to retain the dielectric member 164 within the first and second counterbores 180 and 182 and prevent axial movement thereof. A C-shaped retaining ring 130 is arranged in loosely surrounding engagement with the reduced diameter 170 between the shoulders 172 and 174 of the conductive body 160. The retaining ring 130, as set forth above and as best seen in FIGS. 13 and 14, includes a tapered outer surface 134, an inner wall or diameter 136, and an outer wall or diameter 138. The inner diameter 136 of the retaining ring is greater than the reduced diameter 170 but the two ends 140 and 142 are spaced apart a distance that is less than the reduced diameter, so that the ring 130 is held captive to the conductive body 160. As stated above, in the case of the connector 80, the ring 130 includes properties that allow it to resiliently deflect outwardly when it is assembled to the conductive body 160. In a manner similar to that shown in FIGS. 18, 19, and 20, the ring 130 is expanded outwardly by forcing the two ends 140 and 142 against the reduced diameter 170. This causes the radiused camming surfaces 144,146 to cam outwardly as they ride around the diameter 170, forcing the ends 140 and 142 apart until the two ends pass over the high point of the diameter and then return to their free state position with the ring in surrounding engagement with the reduced diameter 170, as shown in FIG. 15. At this point the retaining ring 130 is held captive on the connector 82. The retaining ring 130 is arranged to secure the connector 82 in an opening 202 in the housing 84, as shown in FIG. 6, in a manner similar to that of the connector 80. As the connector 82 is inserted into the opening 202, the tapered surface 134 engages an edge 204 of the opening and cams inwardly to reduce the outer diameter of the ring until it passes into and through the opening, and then snaps outwardly to its original position to lock against a shoulder 206 in the housing, as shown in FIG. 6. There is sufficient clearance between the inner diameter 136 of the ring 130 and the diameter 170 of the conductive body 160 for the ring 130 to reduce in size and pass through the opening 204.

It will be appreciated that the total deflection of the retaining ring 130, from its expanded position, as shown in FIG. 19, when being assembled to the connector 80 or the connector 82, to it compressed position, not shown, when it is being inserted into the opening 148 or 202 of the housing 84, is accomplished within the elastic limit of the ring 130 so that a permanent set does not result, thereby eliminating the need for a subsequent forming operation to return the retaining ring back 130 to its original shape and size.

An important advantage of the present invention is that the relatively soft plated surfaces of the connectors are not marred or damaged in any way when the rings are installed. This is due to the retaining rings 130 having camming surfaces on their ends and being made of a plastic material that is softer than the conductive plating on the surfaces of the diameters 100 and 170. Another important advantage is that the precision that heretofore was present only in connectors that were manufactured on screw machines, at relatively high cost, is now easily attainable in the much less expensive present connectors having integrally formed die cast conductive bodies and deep drawn receptacle contacts.

I claim:

1. A coaxial electrical connector comprising:

(a) a conductive body of unitary construction having an outer pin contact for interconnecting with a receptacle contact of a mating connector, an outer diameter adjacent said outer pin contact, and a hole extending axially therethrough, said hole having a counterbore in an end of said conductive body terminating in a shoulder;

(b) an inner receptacle contact arranged coaxially within said outer receptacle contact for interconnection with a pin contact of a mating connector;

(d) a dielectric member having a first end in engagement with said inner receptacle contact and said hole of said conductive body and a second end in engagement with said inner receptacle contact and said counterbore adjacent said end of said conductive body, including a flange intermediate said first and second ends in abutting engagement with said shoulder of said counterbore, and wherein said end of said conductive body is deformed to engage said second end of said dielectric member so that said dielectric member is retained between said shoulder and said deformed end; and (e) wherein said conductive body includes a reduced diameter in said outer diameter and said connector includes a retaining ring, formed of a material which is softer than said reduced diameter of said conductive body and having radiused camming surfaces, surrounding a portion of said reduced diameter for holding said connector in an opening in a housing.

2. The connector according to claim 1 wherein said retaining ring is adapted to be loosely received in surrounding engagement with said reduced diameter of said shank, the surface of said reduced diameter being relatively soft and malleable, said ring having an outer wall and an inner wall terminating at a first edge and a second edge spaced from said first edge a distance that is smaller than said reduced diameter, said outer and inner walls being concentric with an axis of said ring, wherein said first and second edges include said radiused camming surfaces that cause said first and second edges to deflect away from each other when said radiused camming surfaces are forced laterally against said reduced diameter until said edges pass over said reduced diameter and resiliently deflect toward each other into said loose surrounding engagement therewith, without marring said surface of said reduced diameter.

3. An electrical connector having a retaining ring adapted to be loosely received in surrounding engagement with a reduced diameter in an outer surface of said electrical connector for holding said connector within an opening in a housing, the surface of said reduced diameter being relatively soft and malleable characterized by:

said retaining ring being formed of a material which is softer than said reduced diameter and having an outer wall and an inner wall terminating at a first edge and a second edge spaced from said first edge a distance that is smaller than said reduced diameter, wherein said first and second edges include rounded camming surfaces that cause said first and second edges to deflect away from each other when said rounded camming surfaces are forced laterally against said reduced diameter until said edges pass over said reduced diameter and resiliently deflect toward each other into said loose surrounding engagement therewith, without marring said surface of said reduced diameter.

4. A coaxial electrical connector having a conductive body being profiled to have a reduced diameter portion comprising:

a retaining ring surrounding a portion of said reduced diameter and adapted to be loosely received in surrounding engagement therewith, said retaining ring having an outer wall and an inner wall, each wall being concentric and terminating at respective first and second edges, each edge having rounded camming surfaces, and being spaced from the other a distance that is smaller than the reduced diameter, whereby said rounded camming surfaces cause said first and second edges to deflect away from each other when said rounded camming surfaces are forced laterally against said reduced diameter until said edges pass over said reduced diameter and resiliently deflect toward each other into loose surrounding engagement therewith, without marring the surface of the reduced diameter portion.

5. A coaxial electrical connector having an inner conductor and an outer conductor separated by a dielectric material wherein the outer conductive is profiled to have a retaining ring receiving area, the electrical connector comprising:

a retaining ring adapted to be loosely received in surrounding engagement with the retaining ring receiving area, the ring having an outer wall and an inner wall concentric to the outer wall terminating at a first edge and a second edge spaced from the first edge to define a ring opening which is smaller than an outer diameter of the retaining ring receiving area, wherein said first and second edges include camming surfaces that cause said first and second edges to deflect away from each other when said retaining ring receiving area is forced laterally into said ring opening until said edges pass over said retaining ring receiving area and resiliently deflect toward each other into loose surrounding engagement therewith, without marring said retaining ring receiving area.

* * * * *